United States Patent [19]

Macken

[11] 3,941,676

[45] Mar. 2, 1976

[54] ADJUSTABLE ELECTRODE

[75] Inventor: Elmer Nelson Macken, Stamford, Conn.

[73] Assignee: Olin Corporation, New Haven, Conn.

[22] Filed: Dec. 27, 1974

[21] Appl. No.: 536,878

[52] U.S. Cl. ..... 204/266; 204/252; 204/280; 204/284; 204/286; 204/288

[51] Int. Cl.[2] ..... B01K 3/04; C23B 5/68

[58] Field of Search ..... 204/252, 266, 280, 284, 204/286, 288

[56] References Cited

UNITED STATES PATENTS

| | | | |
|---|---|---|---|
| 3,674,676 | 7/1972 | Fogelman | 204/252 X |
| 3,803,016 | 4/1974 | Conner, Jr. | 204/266 X |

*Primary Examiner*—G. L. Kaplan
*Assistant Examiner*—A. C. Prescott
*Attorney, Agent, or Firm*—James B. Haglind; Donald F. Clements; T. P. O'Day

[57] ABSTRACT

An adjustable electrode for use in electrolytic cells is provided. The electrode comprises two electrode surfaces positioned in parallel and having a space between them. A rotatable element is attached to each of the electrode surfaces. Upon rotation of the element, the space between the electrode surfaces may be varied. Variation in the space between electrode surfaces is desirable when assembling the electrodes in the cell and in providing the optimum gap between electrodes of opposite charge.

The adjustable electrode is employed in cells for providing chlorine and caustic soda or oxychlorine compounds by the electrolysis of alkali metal chloride solutions.

17 Claims, 7 Drawing Figures

ADJUSTABLE ELECTRODE

The invention relates to electrolytic cells for the electrolysis of aqueous salt solutions. More particularly, this invention relates to adjustable electrodes employed in electrolytic cells for the electrolysis of aqueous alkali metal chloride solutions.

It is known to employ adjustable electrodes in, for example, diaphragm-type electrolytic cells, as illustrated by U.S. Pat. No. 3,674,676, issued July 4, 1972, to E. I. Fogelman. In this patent, expandable electrodes are employed in a cell having the electrodes attached to the bottom or base of the cell and extending upwards. Current is supplied to the electrodes through a riser which is attached to the cell bottom or cell base and is positioned in the space between two adjacent and parallel anode surfaces. Two movable members are attached to each of the electrode surfaces and are also positioned in the space between the electrode surfaces. The movable members are separate units which may also be attached to the riser; where this is the case, they must be electrically conductive. To change the electrode space, each of the members must be adjusted separately. In addition, after the cell has been assembled, it is difficult to readjust the electrode spacing. Further, the adjustable electrodes of U.S. Pat. No. 3,674,676 are not suitable for use in electrolytic cells where the electrodes are attached to electrode plates which are positioned vertically.

An improved adjustable electrode is therefore required where the inter-electrode spacing can be readily and conveniently changed.

It is an object of the present invention to provide a novel adjustable electrode useful in electrolytic cells for the production of chlorine and oxychlorine compounds.

An additional object of this invention is to provide a novel adjustable electrode useful in electrolytic cells employing metal electrodes.

A further object of the present invention is to provide a novel adjustable electrode useful in electrolytic cells in which the electrode plates are positioned vertically.

Another object of the present invention is to provide a novel adjustable electrode where the adjustable elements are independent of those elements supplying current to the electrodes.

These and other objects of the present invention are accomplished in an adjustable electrode suitable for use in a cell for the electrolysis of alkali metal chlorides which comprises two electrode surfaces positioned in parallel and having a space between the electrode surfaces. A rotatable shaft having means of attachment to each of the electrode surfaces whereby upon rotation of the rotatable shaft, the space between the electrode surfaces may be varied.

Accompanying FIGS. 1–7 illustrate the novel adjustable electrodes of the present invention. Corresponding parts have the same numbers in all Figures.

Figure 5:
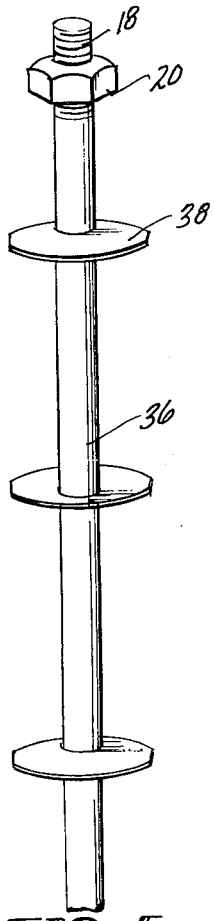

FIG. 5 portrays an alternate embodiment of the rotatable shaft of the present invention.

Figure 6:
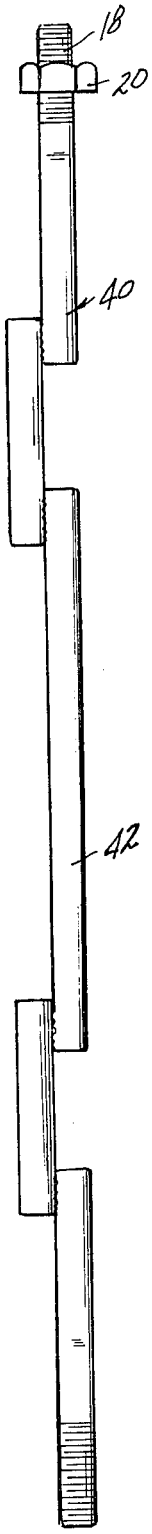

FIG. 6 represents an additional embodiment of the rotatable shaft of the present invention.

Figure 7:
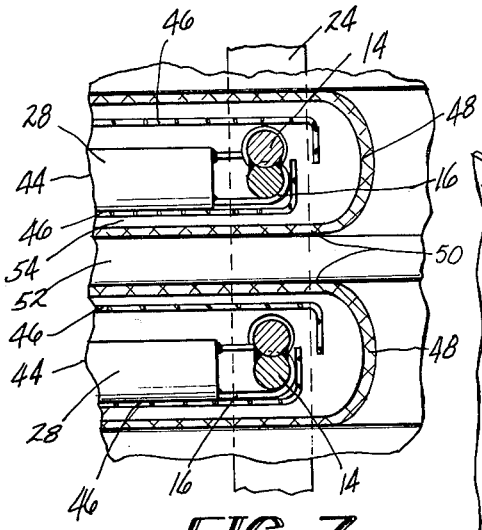

FIG. 7 depicts a top view of a pair of adjustable electrodes of the present invention.

Figure 1:
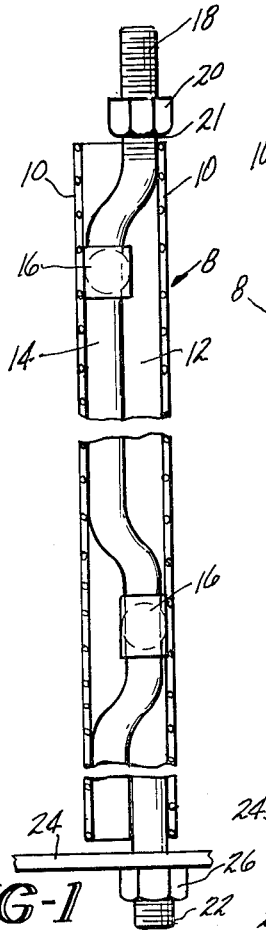
FIG. 1 illustrates a side view of an adjustable electrode of the present invention in expanded form.
Figure 2:
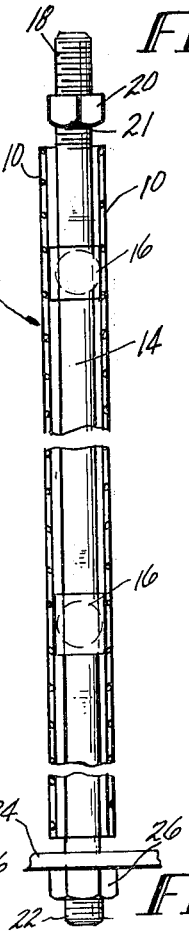
FIG. 2 represents the adjustable electrode of FIG. 1 in contracted form.

Electrode 8 in FIG. 1 is composed of electrode surfaces 10 having space 12 between them. Rotatable shaft 14 is positioned within space 12 and is retained by clips 16 which are alternately attached to electrode surfaces 10. Rotatable shaft 14 has upper threaded end 18 to which nut 20 is secured by weld 21 and lower threaded end 22 on which space bar 24 is supported by nut 26. Nut 26 permits rotatable shaft 14 to turn the desired distance while retaining the space bar in position. In FIG. 1, space 12 is at a maximum and electrode 8 is in an expanded position. By turning nut 20, electrode surfaces 10 are drawn together and space 12 is at a minimum and electrode 8 is in a contracted position, as shown in FIG. 2.

Figure 3:
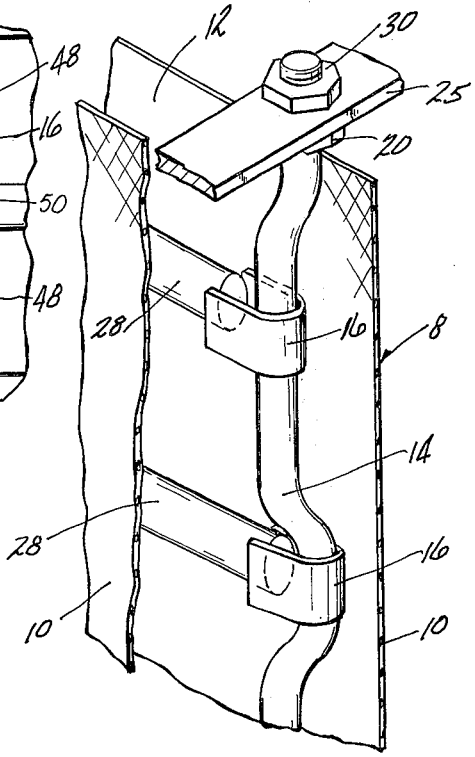
FIG. 3 depicts a perspective view of a portion of an adjustable electrode of the present invention.

FIG. 3 illustrates a perspective view of a portion of electrode 8 which includes electro-conductive supports 28, each of which is attached to only one of the electrodes surfaces 10 and are alternately positioned along electrode surfaces 10. Clips 16 are attached to the ends of electro-conductive supports 28. Positioned above nut 20 on upper threaded end 18 of rotatable shaft 14 is space bar 25 which is secured by nut 30.

Figure 4:
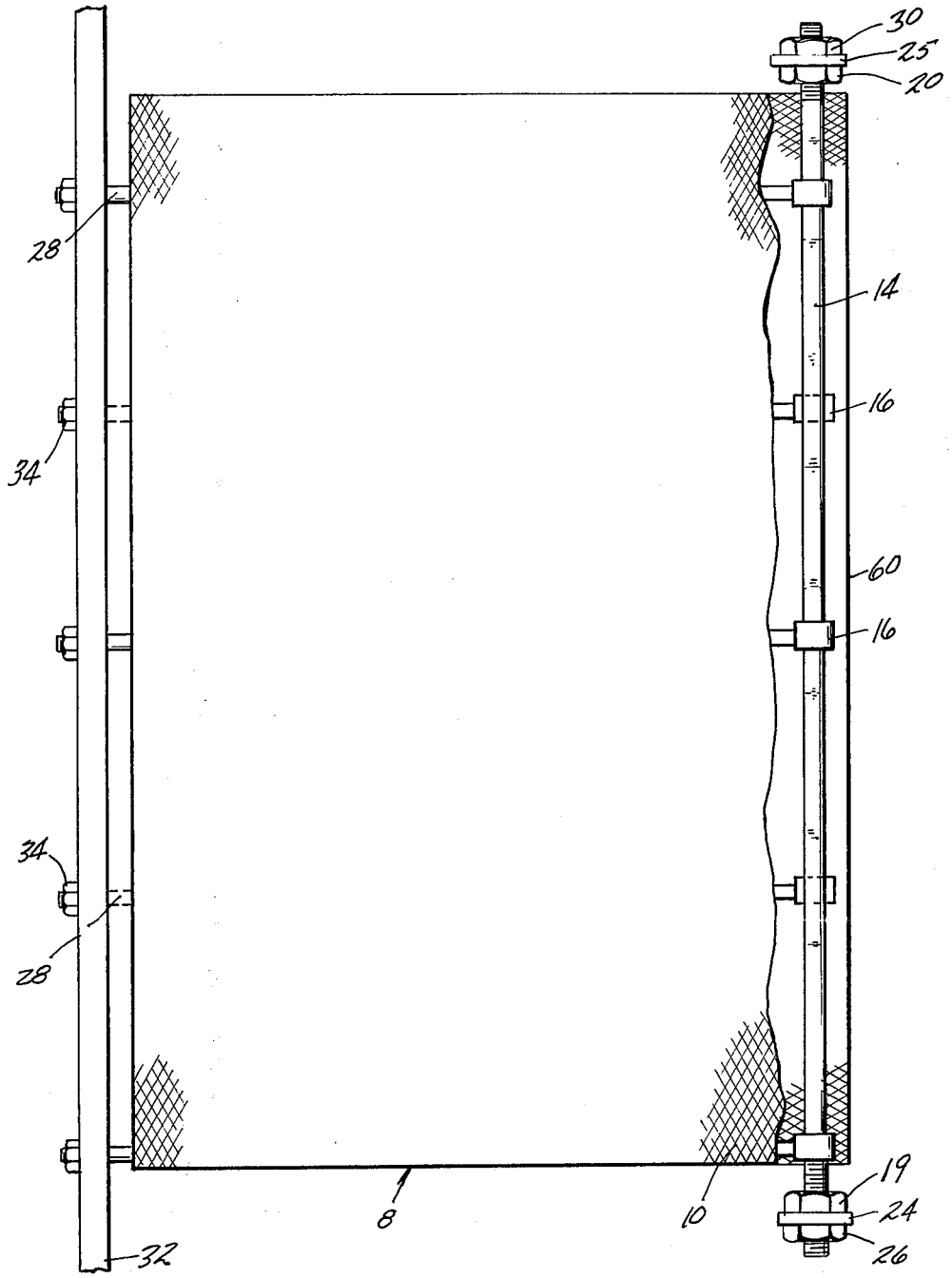
FIG. 4 illustrates a side view of an electrode assembly employing the adjustable electrode of the present invention.

An electrode assembly incorporating the rotating shaft for adjusting the intra-electrode surface space is illustrated in FIG. 4. Electrode plate 32 has electrode 8 attached by means of a plurality of electroconductive supports 28 which are secured to electrode plate 32 by nuts 34. Rotatable shaft 14, attached to electrode surfaces 10, by clips 16, is positioned near the leading edge 60 of electrode 8. Nuts 20 and 19 are welded to threaded ends 18 and 22, respectively. Space bars 25 and 24 are secured by nuts 30 and 26, respectively.

FIG. 5 depicts an alternate embodiment where the rotatable shaft is a cam shaft 36 having truncated cams 38.

In a further embodiment shown in FIG. 6, the rotatable shaft is a crank shaft 40 composed of sections 42 laterally attached along a portion of each end of the sections.

FIG. 7 illustrates a top view of a cross section in which two adjustable electrodes of the present invention are employed as anodes. Anodes 44, having anode surfaces 46 are interleaved between cathodes 48 having cathode surfaces 50 attached to conductor 52 which is attached to the cathode plate (not shown). Anodes 44, in the expanded mode, are spaced apart from cathodes 48 by the minimum anode-cathode gap 54. Rotatable shaft 14 is contained in clips 16 which are attached to electroconductive supports 28. Space bar 24, attached to the lower ends of rotatable shafts 14, maintains a constant inter-anode distance.

In the adjustable electrode of the present invention, the rotatable shaft used may have any suitable configuration, such as that of a crank shaft, cam shaft, drive shaft or arbor.

The shaft has attachment means interconnecting the shaft and the electrode surface. Suitable attachment means include clips or plates which are secured to the electrode surfaces and affixed to the rotatable shaft. For example, the attachment means of FIGS. 1–3 is a U-shaped clip which is attached, for example by brazing or welding, along one side of the U to the electrode surface and which encloses a section of the rotatable shaft. The shaft's attachment means are preferably attached to the electrode surfaces on the non-active sides that is, on the sides not adjacent to the opposite electrode. They are attached in the space between electrode surfaces having the same electrical charge. If desired, the attachment means may also be attached to the electroconductive supports supplying current to the electrode surfaces. The space betweeen electrode surfaces may be any suitable distance, for example, from about 0.25 inch to about 4 inches, preferably from about 0.5 to about 1.5 inches, and more preferably from about 0.625 inch to about 1.25 inches.

The rotatable shaft may be located within the space between electrode surfaces, being positioned at any suitable location. A preferred location is near the leading edge of the electrode. The leading edge is that edge of the electrode, which in the assembled cell is furthest away from the electrode plate supplying current to the electrode. Where the electrode plates are positioned vertically, as shown in FIG. 4, the leading edge of the electrode corresponds to edge 60.

Where the rotatable shaft is positioned outside of the intra-electrode space, for example, above or below the electrode surfaces, the shaft has attachment means to the electrode surfaces which may be rigid or flexible. Suitable examples include a brace or strut or a spring or leaf. It is desirable where the rotatable shaft is located above or below the electrode surfaces to allow sufficient space between the edges of the electrode surfaces and the shaft to permit the flow of fluids through the intra-electrode space.

Rotation means for turning the shaft may be any suitable mechanical or manual means. In one embodiment, the rotatable shaft is threaded at one end and a nut secured to the threaded section, for example, by welding. The shaft can then be rotated manually with a wrench. The degree of rotation for the rotatable shaft may be any convenient amount, for example, from about 5° to about 90°.

Upon rotation of the shaft, the spacing between the two electrode surfaces is varied and the spacing between the anode and cathode changed. It is desirable prior to assembling the electrodes in a cell to bring the electrode surfaces as close together as possible, providing the maximum spacing between anodes and cathodes. After the electrodes have been intermeshed, the space between anodes and cathodes is reduced to the gap desired during cell operation. The adjustable electrode of the present invention provides for ease and convenience of adjustment of the anode-cathode spacing, both before and after electrode assembly.

Any suitable material of construction for the rotatable shaft may be used which is resistant to the gases and liquids to which it is exposed. For example, nonconducting materials such as a ceramics or plastics such as polytetrafluoroethylene, or polyvinylchloride may be employed. When the rotatable shaft is suitably electrically conductive, the material selected may depend on whether the electrode is being used as an anode or a cathode. For example, when serving as an anode, a suitable metal is copper, silver, steel, magnesium or aluminum covered by a chlorine-resistant metal such as titanium or tantalum. Where the electrode serves as the cathode, the rotatable shaft is suitably, for example, steel, nickel, copper or coated conductive materials, such as nickel coated copper.

The electrodes used are preferably metal electrodes. Where the electrode surface serves as the anode, a foraminous metal which is a good electrical conductor may be used. It is preferred to employ a valve metal, such as titanium or tantalum or a metal, for example, steel, copper or aluminum clad with a valve metal such as tantalum or titanium. The valve metal has a thin coating over at least part of its surface of a platinum group metal, platinum group metal oxide, an alloy of a platinum group metal or a mixture thereof. The term "platinum group metal" as used in the specification, means an element of the group consisting of ruthenium, rhodium, palladium, osmium, iridium, and platinum.

The anode surfaces may be in various forms, such as an expanded mesh which is flattened or unflattened, and having slits horizontally, vertically or angularly. Other suitable forms include woven wire cloth, which is flattened or unflattened, bars, wires, or strips arranged, for example, vertically, and sheets or plates having perforations, slits, or louvered openings.

A preferred anode surface is a foraminous metal mesh having good electrical conductivity in the vertical direction.

As the cathode, the electrode surface is suitably a metal screen or mesh where the metal is, for example, iron, steel, nickel, or tantalum. If desired, at least a portion of the cathode surface may be coated with a platinum group metal, oxide or alloy, as defined above.

Conductive supports are attached to the electrode surfaces to supply electric current from the electrode plates to the electrode surfaces. The conductive supports are preferably located within the intra-electrode surface space. In a preferred embodiment, the conductive supports are attached substantially perpendicular to the electrode plate, with one conductive support separately attached to each of the electrode surfaces. The conductive supports may be attached so that they are directly opposite each other, or alternately positioned. Where alternated, the spacing between conductive supports on the same electrode surface is selected to provide optimum current distribution and mechanical support.

Any convenient physical form of conductive support may be used such as rods, strips or bars. A preferred form of conductive support is a rod having a diameter of from about 0.25 to about 3 inches and preferably from about 0.5 to about 1.5 inches.

The electrode plates are suitably constructed of nonconductive materials, such as concrete or fiber-reinforced plastic or a conductive metal, such as steel or copper. To avoid corrosive damage, the conductive metal may be covered with, for example, hard rubber or a plastic, such as polytetrafluoroethylene or fiber-reinforced plastic. If desired, titanium or a titanium-clad base metal may be used where the electrode plate serves as the anode plate.

In a preferred embodiment, the adjustable electrode of the present invention is used in a diaphragm cell where the electrode plates are both positioned vertically. The anode plate has a plurality of anodes attached and the cathode plate, which is positioned opposite the anode plate has a plurality of cathodes attached. The anodes and cathodes project horizontally across the cell. When the cell is assembled, each cathode is inserted between two adjacent anodes. An anode is spaced apart from an adjacent cathode a distance of from about 0.125 to about 0.375 of an inch, preferably from about 0.190 to about 0.325 of an inch.

A plurality of electrodes are attached to the electrode plates, the exact number depending on the size of the electrode plate. For example, in an electrolytic cell employing the electrode assembly of the present invention, from about 2 to about 100 or more, or preferably from about 5 to about 50 electrodes are attached to the electrode plate.

A diaphragm material is applied or deposited on the cathodes. Any inert material which is fluid permeable and halogen-resistant may be used. Suitable diaphragm materials include asbestos, polyvinylidine chloride, perfluorosulfonic acid membranes made from a copolymer of tetrafluoroethylene and a vinyl ether (such as "Nafion" produced by E. I. DuPont de Nemours and Company), polypropylene or polytetrafluoroethylene.

To maintain constant or equal spacing between a group of electrodes having the same electrical charge, a spacer bar is employed. The bar has a series of openings equidistantly spaced along the bar with the number of openings corresponding to the number of rotatable shafts in the group. The bar is mounted on the rotatable shafts to interconnect the rotatable shafts and is secured to the shaft, for example, by a nut. The bar may be located at either the upper end or lower end, or both ends of the rotatable shaft to maintain a constant distance between rotatable shafts.

What is claimed is:

1. An adjustable electrode for an electrolytic cell which comprises:

a. two electrode surfaces positioned in parallel and having a space between said electrode surfaces, b. conductive supports attached to said electrode surfaces, c. a rotatable shaft, independent of said conductive supports, having means of attachment to each of said electrode surfaces whereby upon rotation of said rotatable shaft said space between said electrode surfaces may be varied.

2. The adjustable electrode of claim 1 wherein said space between said electrode surfaces is from about 0.25 to about 4.0 inches.

3. The adjustable electrode of claim 1 wherein said rotatable shaft is comprised of a non-conductive material.

4. The adjustable electrode of claim 1 wherein said rotatable shaft is positioned in said space between said electrode surfaces.

5. The adjustable electrode of claim 4 wherein said rotatable shaft is positioned near the leading edges of said electrode surfaces.

6. An adjustable electrode assembly suitable for use in a cell for the electrolysis of alkali metal chloride solutions which comprises:

a. an electrode plate, b. an electrode having two electrode surfaces positioned in parallel and having a space between said electrode surfaces, c. at least two conductive supports, one said conductive support separately attached to each of said electrode surfaces and positioned in said space between said electrode surfaces, d. openings in said electrode plate for attachment of said conductive supports, said conductive supports being attached to and substantially perpendicular to said electrode plate, e. a rotatable shaft having means of attachment to each of said electrode surfaces whereby upon rotation of said rotatable shaft said space between said electrode surfaces may be varied.

7. The adjustable electrode assembly of claim 6 wherein said electrode is an anode and said electrode plate is an anode plate and has a plurality of said anodes.

8. A diaphragm cell for the electrolysis of an aqueous solution of an alkali metal chloride containing the electrode assembly of claim 7 and having a plurality of cathodes each having a diaphram thereon, said cathodes being interleaved with and spaced apart from said anodes wherein said cathodes are attached to an electrode plate positioned vertically.

9. The diaphragm cell of claim 8 wherein said cathodes are spaced apart from said anodes a distance of from about 0.125 to about 0.375 inch.

10. The diaphragm cell of claim 9 wherein said anode plate is positioned vertically.

11. The diaphragm cell of claim 9 wherein said rotatable shaft for each said anode is positioned between said anode surfaces near the leading edge of said anode.

12. The diaphragm cell of claim 11 wherein said rotatable shaft for each said anode is a crank shaft.

13. The diaphragm cell of claim 7 wherein a bar having openings equidistantly spaced along said bar and corresponding to the number of said rotatable shafts interconnects said rotatable shafts of said anodes and maintains said space between said rotatable shafts at a constant distance.

14. An adjustable electrode for an electrolytic cell which comprises:

a. two electrode surfaces positioned in parallel and having a space between said electrode surfaces, b. a rotatable shaft selected from the group consisting of a crank shaft, cam shaft, drive shaft, or arbor, said rotatable shaft having means of attachment to each of said electrode surfaces whereby upon rotation of said rotatable shaft said space between said electrode surfaces may be varied.

15. The adjustable electrode of claim 14 wherein said rotatable shaft is a crank shaft.

16. The adjustable electrode of claim 14 wherein said rotatable shaft is a cam shaft.

17. The adjustable electrode of claim 15 wherein said attachment means is a clip and said electrode is an anode.

* * * * *